United States Patent [19]

Stelmasik et al.

[11] 4,169,412

[45] Oct. 2, 1979

[54] SHOP PRESS

[75] Inventors: Gregory A. Stelmasik, South St. Paul; Richard T. Anderson, Burnsville, both of Minn.

[73] Assignee: Owatonna Tool Company, Owatonna, Minn.

[21] Appl. No.: 945,260

[22] Filed: Sep. 25, 1978

[51] Int. Cl.[2] ..... B30B 15/06

[52] U.S. Cl. ..... 100/257; 29/251

[58] Field of Search ..... 100/214, 257; 29/251; 83/527, 539; 254/4 C, 4 R; 248/157, 422

[56] References Cited

U.S. PATENT DOCUMENTS

| | | | |
|---|---|---|---|
| 1,650,818 | 11/1927 | Buffington | 29/251 |
| 1,758,451 | 5/1930 | Manley | 248/422 |
| 3,168,034 | 2/1965 | McClocklin | 100/214 |
| 3,204,444 | 9/1965 | Engel | 100/257 X |
| 3,307,830 | 3/1967 | Van Allen | 100/257 X |

*Primary Examiner*—Billy J. Wilhite

*Attorney, Agent, or Firm*—Wegner, Stellman, McCord, Wiles & Wood

[57] ABSTRACT

A shop press having a vertically-movable bolster which can be locked in any one of a number of positions to side members of the shop press frame and cable and winch structure for causing vertical movement of the bolster including a pair of cables connected one to each end of the bolster and with a pivotal member associated with one cable for varying the length of said one cable to raise the associated bolster end.

8 Claims, 5 Drawing Figures

SHOP PRESS

BACKGROUND OF THE INVENTION

This invention pertains to shop presses having a bolster that can be locked in any one of several different vertical positions and improved cable and winch structure for accurately locating the bolster in a level position without damage to the cables.

Shop presses having an adjustable bolster with a number of different vertical positions normally include a cable and winch structure for causing movement of the bolster to the desired vertical position. A winch having two cables wound thereon which extend one to each of opposite ends of a bolster have been used whereby rotation of the winch should pay out or take up equal lengths of both cables for equal movement of both ends of the bolster. This structure has not been completely satisfactory because of tolerance variations and uneven wind of the cables which can cause problems in maintaining both the bolster ends at the same height.

Applicants' assignee markets shop presses utilizing two cables with a first cable extended between a bolster and the winch and with the second cable extended between ends of the bolster and passing over a series of intermediate pulleys. With this structure, movement of one bolster end by operation of the winch and first cable results in movement of the other end through the second cable. In such a shop press, it is possible to break a cable unless a particular sequence of operation is followed in locking the bolster ends to the side members of the shop press frame.

SUMMARY OF THE INVENTION

The primary feature of the invention disclosed herein is to provide a modified system for causing vertical movement of a shop press bolster wherein a pair of elongate members, such as chains or cables, are connected one to each of opposite ends of the bolster and one of said elongate members has means associated therewith for deflection thereof to effectively shorten the length of that member and raise the associated end of the bolster.

More particularly, the shop press has a handle pivotally mounted to one bolster end and having an end of the elongate member connected thereto and with the handle normally extending in parallel relation with the elongate member whereby pivoting of the handle deflects the member to cause the effective shortening thereof.

An object of the invention is to provide a shop press comprising a frame with a pair of spaced-apart side members, a top member and a vertically-adjustable bolster, pin and hole means at the horizontally-spaced ends of said bolster and side members for locking the bolster in a desired vertical position, and cable and winch means for vertically moving the bolster including a first cable connected between the winch and one end of the bolster, a second cable connected between the ends of the bolster, pulleys on said frame over which said second cable passes whereby vertical movement of the one bolster end by operation of the winch results in movement of the second cable for similar vertical movement of the other bolster end, said second cable having a length whereby the other bolster end is slightly lower than said one bolster end during vertical movement of the bolster, and means operable after said one bolster end is locked in position to elevate the other bolster end to a locking position with the bolster level.

DESCRIPTION OF THE PREFERRED EMBODIMENT

Figure 2:
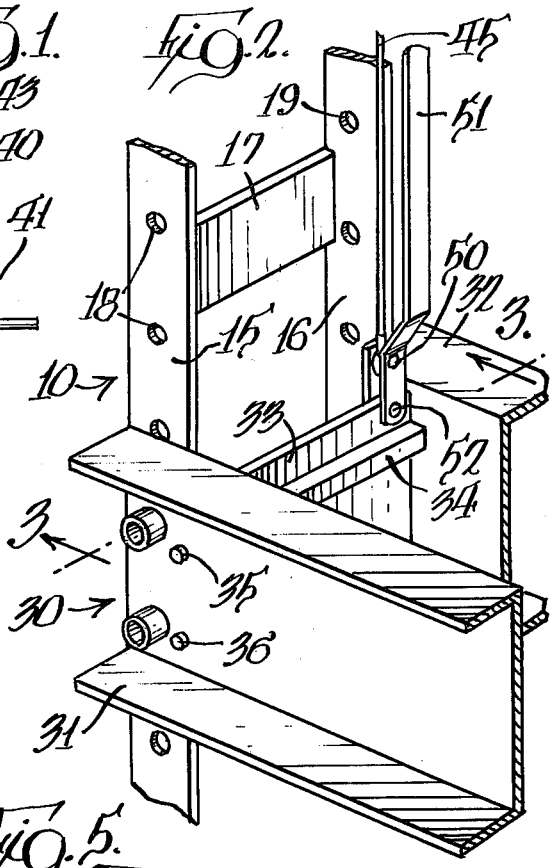
FIG. 2 is a fragmentary perspective view of the shop press showing particularly the cable deflecting structure.
Figure 3:
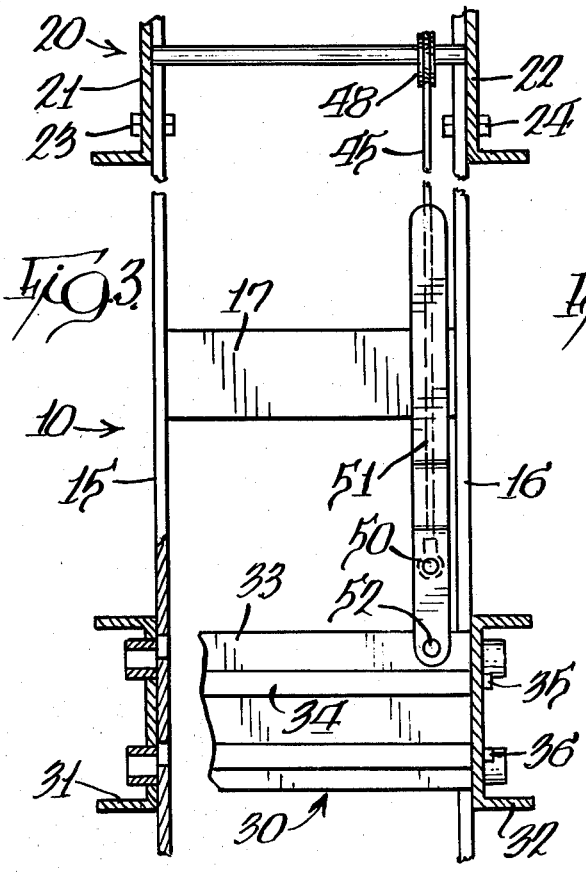
FIG. 3 is a fragmentary vertical section of the shop press with parts broken away, taken generally along the line as indicated at 3—3 in FIG. 2 and with a bolster end shown below its final position.
Figure 5:
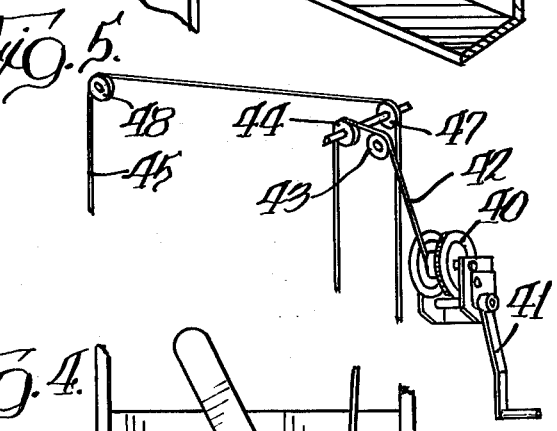
FIG. 5 is a fragmentary perspective view showing parts of the cable and winch system.
Figure 4:
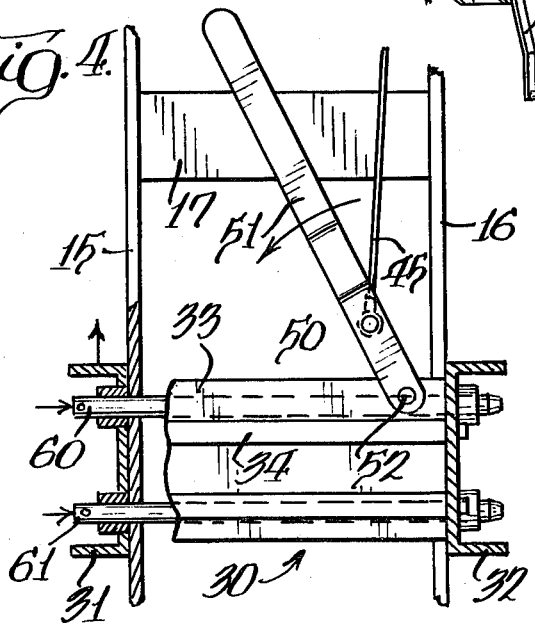
FIG. 4 is a view, similar to FIG. 3; showing the bolster end in final locked position.

The shop press has a frame with a pair of side members, indicated generally at 10 and 11, and with each of the side members being constructed similarly and as shown for side member 10 in FIGS. 2 to 4. A side member has a pair of vertically-extending spaced-apart plates 15 and 16 which are interconnected by vertically-spaced brace members 17. Each of the plates has a series of vertically-spaced holes 18 and 19, respectively, and which are in alignment to provide part of pin and hole means for a purpose described hereinafter. The side members are interconnected by a top member, indicated generally at 20, having spaced-apart places 21 and 22 and which are secured by fasteners 23 and 24 to the upper ends of the side frame plates.

A bolster, indicated generally at 30 is adjustably mounted to the side members 10 and 11 of the frame and is positionable at different heights, dependent upon the desired use of the shop press. The bolster has front and rear channel members 31 and 32, respectively, which extend generally horizontally in spaced-apart relation and which are interconnected by a pair of plates positioned one at each end of the bolster, with one of the plates being identified at 33. This plate is positioned inwardly of the ends of the channel members 31 and 32 to lie clear of the inner ends of the side member plates 15 and 16. The plate carries a pair of vertically-spaced blocks made from tubing with one being shown at 34 and through which a pair of attaching bolts extend. A bolt 35 extends through the block 34 and a bolt 36 extends through the lower block, which is not shown.

The vertical movement of the bolster 30 is caused by a cable and winch system which includes a rotatable sheave 40 which is rotatable by a handle 41. A first cable 42 is wound around the sheave and extends over pulleys 43 and 44 and then downwardly into engagement with one end of the bolster and specifically to the plate 33 interconnecting the bolster channel members 31 and 32. A second cable 45 extends downwardly from the same end of the bolster and passes around a series of intermediate pulleys rotatably mounted relative to the shop press frame including pulleys 46, 47 and 48 and to a location adjacent the other end of the bolster. An end 50 of the cable 45 is connected to a handle 51 which is pivotally connected to the bolster plate 33 at 52. The bolster is locked in a level position at a desired vertical height by pin and hole means including the pins 60, 61, 62 and 63. The pins 60 and 61 extend through a pair of the holes 18 in side member plate 15 and a pair of holes 19 in side member plate 16, with the pins 62 and 63 extending through corresponding holes in the other frame side member. This locked condition is shown in FIG. 4. Although specific reference is made to the use of cables, it will be obvious that chains could be used in place of cables.

Figure 1:
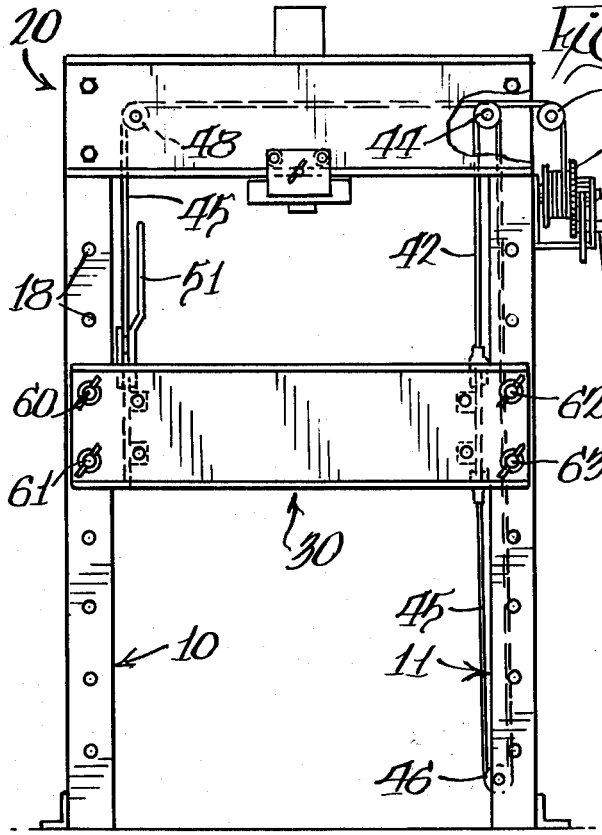
FIG. 1 is a front elevational view of the shop press showing the bolster locked in a selected vertical position.

In locating the bolster at a desired level, all of the pins 60–63 are removed and the handle 41 is then rotated in the desired direction. This causes movement of the first cable 42 with resulting corresponding vertical movement of one end of the bolster. Corresponding vertical movement of the other end of the bolster is simultaneously effected by movement of the second cable 45. It is desirable to not have any tension on the cables during use of the shop press since during a pressing operation there could be sufficient increased tension on the cables as to cause a cable failure. In order to avoid this problem, the shop press is designed with the second cable 45 of a length whereby the left end of the bolster, as viewed in FIG. 1, is normally lower than the right end during vertical adjusting movement thereof. With this condition, the operating instructions provide that the left end should first be vertically located and one of the pins 60 and 61 inserted. The first cable 42 can then be relaxed to lower the right end of the bolster to a position where the locking pins 62 and 63 can be inserted. It is frequently found, however, that an operator will locate the right end of the bolster because of it being convenient to the location of the winch and after insertion of one of the locking pins 62 and 63 will attempt to operate the winch to raise the left end of the bolster. This results in breaking the first cable 42 since the cable is pulling on a fixed end of the bolster.

With the structure disclosed herein, the operator can locate the right end of the bolster and insert one locking pin and then pivot the handle 51 from the position shown in FIG. 3 in which it extends parallel to the cable 45 to an inclined position to deflect the cable and effectively shorten it which results in raising the left end of the bolster from the position shown in FIG. 3 to the position shown in FIG. 4. The pins 60 and 61 can then be inserted and the handle 51 released, which relaxes second cable 45 and the cable 42 can also be relaxed.

We claim:

1. In a shop press having side frame members and a bolster adjustably mounted thereon, releasable means at both ends of the bolster for fastening the bolster to the side frame members, means for adjusting the height of said bolster including a winch and cable system with a pair of cable lengths operatively connected one to each end of the bolster, and means for deflecting one of said cable lengths to effectively shorten said one cable length and raise the adjacent end of the bolster.

2. A shop press as defined in claim 1 wherein said deflecting means comprises a handle pivoted on said bolster and having an end of said one cable length connected thereto.

3. A shop press comprising, a frame with spaced-apart side members, a bolster extended between said side members and positionable at different heights, removable means fastening the bolster at opposite ends thereof to said side members at a desired height, a pair of elongate members connected one to each end of said bolster, a winch associated with said elongate members for causing movement thereof to cause corresponding change in height of the bolster, and means associated with one of said elongate members to shorten the effective length thereof and raise the associated end of the bolster relative to the other end.

4. A shop press as defined in claim 3 wherein said one elongate member is connected to both ends of the bolster and extends over intermediate pulleys to transmit movement of one bolster end to the other, and the other elongate member extends from said one bolster end to said winch.

5. A shop press as defined in claim 4 wherein said one elongate member has a length to maintain said one bolster end higher than the outer end during vertical movement of the bolster.

6. A shop press as defined in claim 4 wherein said elongate members are cables.

7. A shop press comprising, a frame with a pair of spaced-apart side members, a top member and a vertically-adjustable bolster, pin and hole means at the horizontally spaced ends of said bolster and side members for locking the boster in a desired vertical position, and cable and winch means for vertically moving the bolster including a first cable connected between the winch and one end of the bolster, a second cable connected between the ends of the bolster, pulleys on said frame over which said second cable passes whereby vertical movement of the one bolster end by operation of the winch results in movement of the second cable for similar vertical movement of the other bolster end, said second cable having a length whereby the other bolster end is slightly lower than said one bolster end during vertical movement of the bolster, and means operable after said one bolster end is locked in position to elevate the other bolster end to a locking position with the bolster level.

8. A shop press as defined in claim 7 wherein said means for elevating the other bolster end includes a handle pivotally mounted to said other bolster end and having an end of said second cable connected thereto, said handle normally extending parallel to said second cable and operating to deflect and thereby shorten the second cable when pivoted out of said normal position.

* * * * *